United States Patent [19]

Brill

[11] 4,217,892

[45] Aug. 19, 1980

[54] HYDRO-THERAPY DEVICE

[76] Inventor: Joseph H. Brill, 5210 E. Deckerville Rd., Deckerville, Mich. 48427

[21] Appl. No.: 64,077

[22] Filed: Aug. 6, 1979

[51] Int. Cl.[2] ..... A61H 9/00

[52] U.S. Cl. ..... 128/66; 4/509

[58] Field of Search ..... 128/66; 4/172.16, 178

[56] References Cited

U.S. PATENT DOCUMENTS

| | | | |
|---|---|---|---|
| 722,232 | 3/1903 | Hoeglauer | 4/178 |
| 3,347,225 | 10/1967 | Salsbury | 128/66 |
| 3,350,724 | 11/1967 | Leigh | 4/178 |
| 3,483,863 | 12/1969 | DeVane | 128/66 |
| 3,565,065 | 2/1971 | Biggs et al. | 128/66 |
| 3,585,991 | 6/1971 | Balamuth | 128/66 |

FOREIGN PATENT DOCUMENTS

| | | | |
|---|---|---|---|
| 692047 | 7/1930 | France | 4/178 |
| 375684 | 6/1932 | United Kingdom | 4/172.16 |

*Primary Examiner*—Lawrence W. Trapp

*Attorney, Agent, or Firm*—Barnes, Kisselle, Raisch & Choate

[57] ABSTRACT

A hydro-therapy machine includes a massage tank connected to a diaphragm pump by means of a pair of conduits with which communicate with apertures in the bottom and side walls of the tank.

12 Claims, 6 Drawing Figures

HYDRO-THERAPY DEVICE

This invention relates to a hydro-therapy device.

Conventional hydro-therapy machines used for massaging various parts of the human body normally employ as the massaging medium a pulsating air-water mixture. I have discovered that a gentle, more deeply penetrating massaging effect can be produced if the pulsating massaging medium does not contain any air.

Accordingly, it is an object of this invention to provide an improved apparatus for massaging parts of a body wherein the massaging medium comprises a plurality of pulsating streams of water containing substantially no air.

A further object of this invention is to provide an improved apparatus of relatively simple and durable construction which can be manufactured economically.

Other objects, features and advantages of the hydro-therapy machine of the present invention will become apparent from the following description and accompanying drawings, in which.

Figure 1:
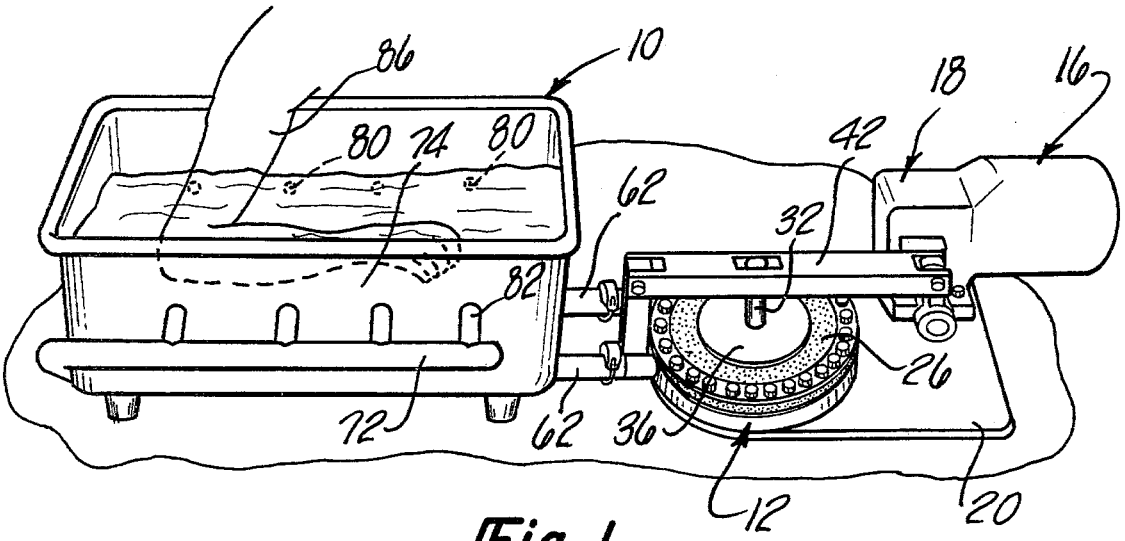
FIG. 1 is a perspective view of the hydro-therapy machine of the present invention.
Figure 2:
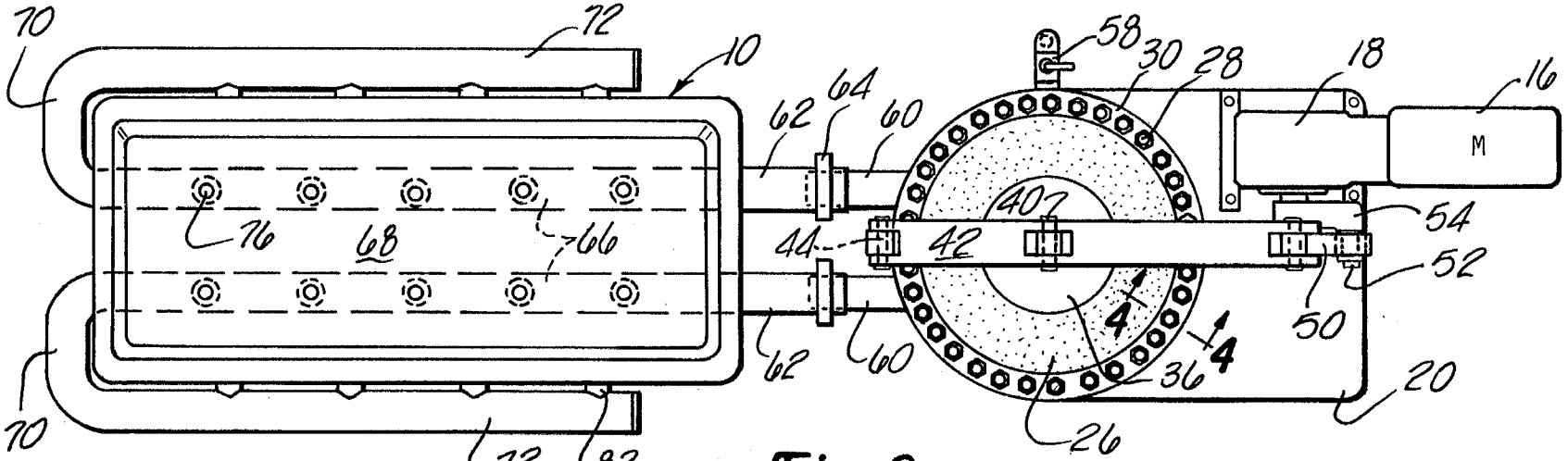
FIG. 2 is a top plan view of the machine.
Figure 3:
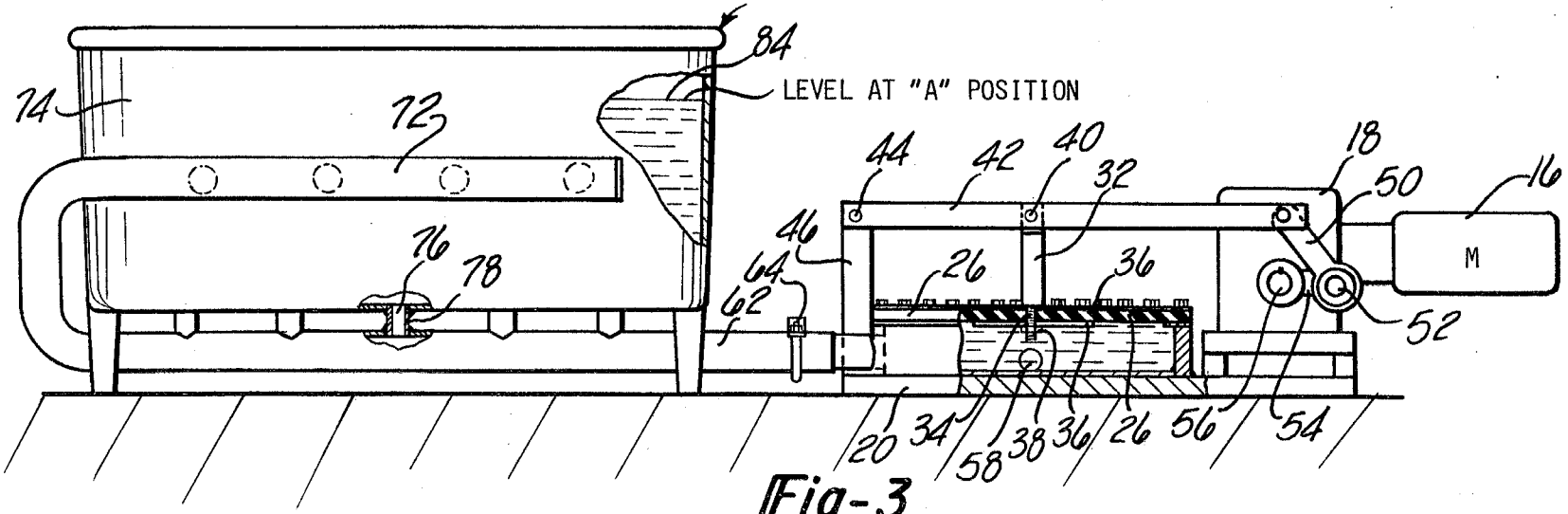
FIG. 3 is a side elevational view of the machine partly in section.

Referring first to FIGS. 1-3 the massaging device of the present invention comprises a tank 10 connected to a diaphragm pump 12 by means of the hereinafter described conduits. Pump 12 is adapted to be operated by an electric motor 16 through a gear reducer 18. Pump 12, motor 16 and gear reducer 18 are preferably fixedly mounted on a common base plate 20.

Figure 4:
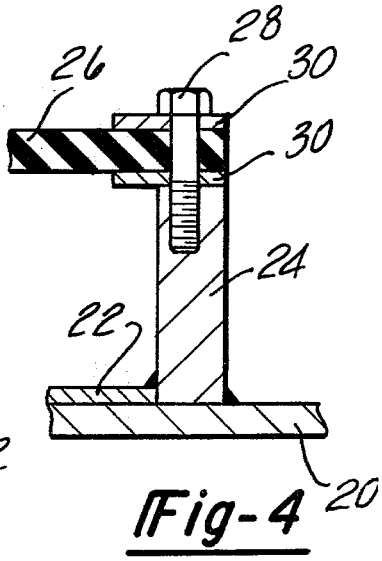
FIG. 4 is a fragmentary sectional view taken along the line 4—4 in FIG. 2.

Pump 12 includes a bottom wall 22 (FIG. 4) and an upstanding cylindrical side wall in sealed relation therewith. Around its upper end side wall 24 has a flexible diaphragm 26 sealingly clamped thereto by means of screws 28 and upper and lower clamping rings 30. A push rod 32 is connected to and extends upwardly from the center of the diaphragm. The lower threaded end 34 of push rod 32 extends through diaphragm 26 and a pair of pressure plates 36 are clamped against the upper and lower faces of the diaphragm by a nut 38 on the threaded end 34 of push rod 32. Push rod 32 is pivotally connected as at 40 to a lever 42. At one end lever 42 is pivotally connected as at 44 with the upper end of a bracket 46 fixedly mounted on base plate 20. The opposite end of lever 42 is connected as at 48 with a connecting rod 50. Rod 50 is in turn pivotally connected as at 52 with a crank 54 keyed to the output shaft 56 of gear reducer 18. The drive between gear reducer 18 and diaphragm 26 is preferably such that when crank 54 extends horizontally diaphragm 26 is in its relaxed horizontal position as shown in FIG. 3. With this arrangement the central portion of diaphragm 26 flexes upwardly and downwardly equal distances from its relaxed horizontal position. Since push rod 32 is connected to lever 42 at approximately the center thereof the total stroke of the diaphragm is approximately equal to the length of crank 54.

At one side thereof pump 12 has a drain valve 58. At the side of pump 12 opposite motor 16 and gear reducer 18 the side wall 24 of the pump is provided with a pair of relatively large nipples 60 to which conduits 62 are connected by couplings 64. Each conduit 62 has a run 66 extending lengthwise below the bottom wall 68 of tank 10. The runs 66 are laterally spaced in generally parallel relation. Each run 66 has an upwardly inclined return bend 70 beyond the end of the tank which connects with a second run 72 that extends horizontally along each of the side walls of tank 10. The bottom wall 68 of the tank is provided with a two series of spaced openings 76 which are connected by short nipples 78 with the runs 66 of conduits 62. Likewise, each side wall 74 of the tank is provided with a horizontally extending series of openings 80 which are connected by short nipples 82 with the runs 72 of conduits 62. The opposite openings 80 in each series are preferably aligned both horizontally and vertically and are preferably staggered intermediate the openings 76 in the bottom wall 68 of the tank.

Figure 5:
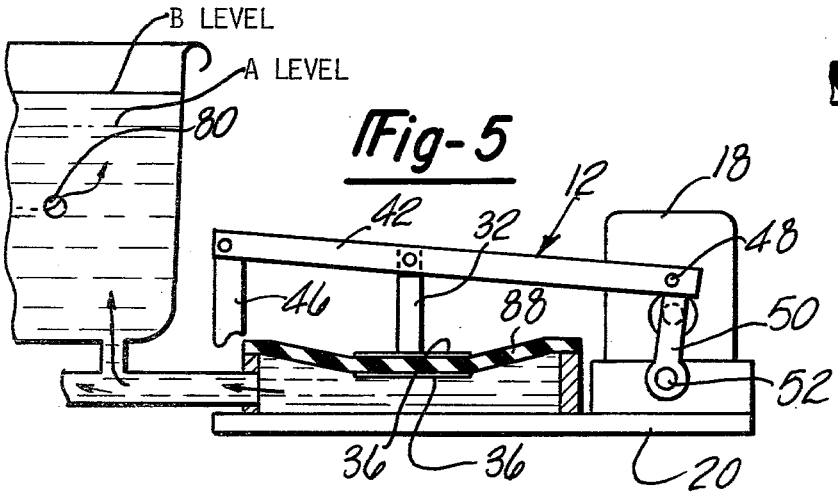
FIGS. 5 and 6 are fragmentary sectional views showing the manner in which the pump is operated.
Figure 6:
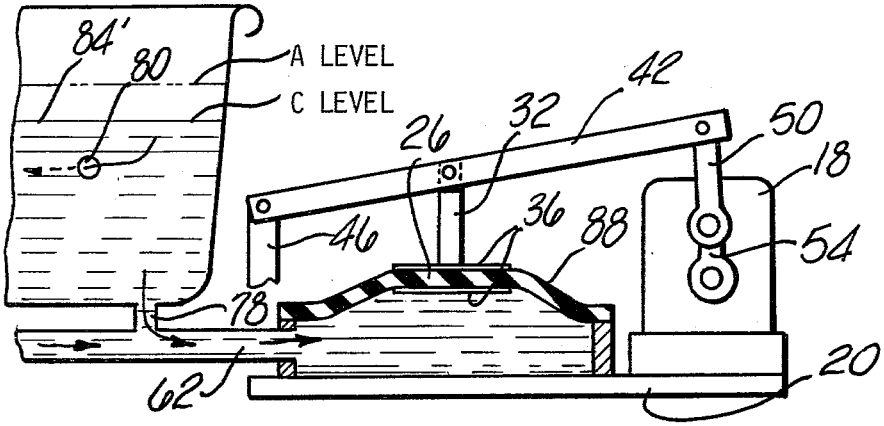

In operation tank 10 is filled with water to a level above the level of openings 80. After pump 12 has been operated for a short period of time all the air in the pump will have been displaced so that the pump and the conduits 62 will be completely filled with water and all air will be excluded therefrom. With all the air displaced from the pump and the diaphragm 26 in its unflexed position the water level in tank 10 is still above the openings 80 as indicated at 84. This level is such that when a body limb, such as a patient's arm 86, is submerged in the tank and the diaphragm is in its most downwardly flexed position (FIG. 5) the water will not spill over the upper edges of the tank walls. Likewise, it is essential that when the diaphragm is flexed to its uppermost position (FIG. 6) the water level 84' is still above the level of the openings 80 in the two side walls of the tank. It therefore follows that when the diaphragm is flexed between its lowermost position shown in FIG. 5 and its uppermost position shown in FIG. 6 the water is pumped back and forth between tank 10 and pump 12. When the diaphragm 26 is flexed downwardly water is discharged into tank 10 through openings 76 and 80 and when the diaphragm flexes upwardly water is drawn from the tank back into the pump. This produces pulsating streams of water at the openings 76,80. Experience has shown that these pulsating water streams produce a very beneficial massaging effect. The pulsating water streams provide a gentle, deep penetrating massage action which stimulates blood circulation much more effectively than pulsating streams of a water-air mixture.

Diaphragm 26 is preferably fabricated from a reinforced elastic material such as surgical rubber reinforced with nylon cord. The water pressure developed at the openings 68,60 is dependent to a large extent upon the area of the pressure plates 36. Stated differently, all other parameters remaining the same, the water pressure developed increases as the diameter of pressure plates 36 increase. This results from the fact that when the elastic diaphragm is in its horizontal mid-position shown in FIG. 3, it is flat and somewhat taut. The diaphragm is stretched when flexed from this mid-position. The size of pressure plates 36 determines the size of the annular portion 88 of the diaphragm that is subjected to a flexing action.

For example, in one typical model of hydro-therapy machine of the present invention where the diaphragm pump has a diameter of 12 inches, a pressure of ¾ lbs. per square inch is developed with 6 inch diameter pressure plates 36 and a pressure of 1¼ lbs. per square inch is developed with pressure plates having a diameter of 7 inches. In this particular model the stroke of the diaphragm is 2½ inches, the conduits 62 are 1½ inches in diameter and tank 10 is provided with two rows of five holes 76 of ⅝ inch diameter in the bottom wall and four holes 80 of ⅝ inch diameter in each side wall. The diaphragm is reciprocated at the rate of about 50 strokes per minute.

I claim:

1. A hydro-therapy device comprising a massage tank open at its upper end and having a bottom wall and a pair of opposite side walls, a pump having a pumping chamber defined by a reciprocating wall, means for reciprocating said last-mentioned wall to enlarge and diminish the volume of said chamber, conduit means extending from said chamber to said tank, the upper end of said tank being disposed at a level above said chamber, each of said side walls having a series of openings therein, the openings in one side wall being generally opposed to the openings in the opposite side wall, said conduit means being connected to both series of openings whereby when said tank, conduits, and chamber are filled with liquid in an amount such that the liquid level in the tank is above the chamber and above the openings in the side walls and substantially all air is excluded from said chamber and conduit means and said wall of the pump is reciprocated, the liquid is pumped back and forth between said chamber and said tank through said conduit means, the liquid being pumped into said tank being directed as intermittent pulses against opposite sides of a body limb positioned between said side walls and aligned with said openings.

2. A hydro-therapy device as called for in claim 1 wherein said conduit means comprises a pair of conduits extending one along each side wall of the tank and connected with the series of openings in the adjacent side wall and wherein the conduits are connected to the pump so that liquid flows simultaneously in the same direction in both conduits.

3. A hydro-therapy device as called for in claim 2 wherein the openings in one side wall are aligned horizontally and vertically with the openings in the opposite side wall.

4. A hydro-therapy device as called for in claim 1 wherein said bottom wall is also provided with a series of openings therein communicating with said conduit means.

5. A hydro-therapy device as called for in claim 3 wherein said bottom wall has two series of openings therein each series being connected with one of said conduits.

6. A hydro-therapy device as called for in claim 5 wherein the two series of openings in the bottom wall are in generally straight lines that are laterally spaced and extend parallel to the side walls.

7. A hydro-therapy device as called for in claim 6 wherein the series of openings in the opposite side walls are generally aligned both vertically and horizontally and the openings in the two series in the bottom wall are staggered intermediate the openings in the side walls.

8. A hydro-therapy device as called for in claim 1 wherein said pump is of the flexible diaphragm type.

9. A hydro-therapy device as called for in claim 8 wherein the diaphragm defines the top wall of the pump.

10. A hydro-therapy device as called for in claim 9 wherein said power means includes a vertically reciprocating push rod connected to the center of the diaphragm for flexing the diaphragm vertically.

11. A hydro-therapy device as called for in claim 10 wherein the diaphragm is formed of an elastic material and the push rod extends through the diaphragm and including a pair of rigid pressure plates removably clamped against the upper and lower faces of the diaphragm by means including said push rod, said pressure plates serving to maintain the portion of the diaphragm clamped therebetween in a rigid flat condition and thereby determining the annular portion of the diaphragm which flexes in response to reciprocation of the push rod.

12. A hydro-therapy device as called for in claim 11 wherein each pressure plate comprises a circular disc having a diameter which is at least about ½ the lateral dimension of the diaphragm.

* * * * *